United States Patent [19]

Blachly et al.

[11] 4,231,557

[45] Nov. 4, 1980

[54] PORTABLE WORK BENCH

[75] Inventors: Donald L. Blachly, Excelsior Township, Sauk County, Wis.; Daniel A. Terpstra, Kirkwood, Mo.

[73] Assignee: Emerson Electric Co., St. Louis, Mo.

[21] Appl. No.: 13,208

[22] Filed: Feb. 21, 1979

[51] Int. Cl.[3] ..... B25B 1/10

[52] U.S. Cl. ..... 269/139; 269/219; 269/244; 269/901

[58] Field of Search ..... 144/285, 286 R, 288 R; 269/16, 139, 219, 220, 221, 222, 240, 244, 321 CF

[56] References Cited

U.S. PATENT DOCUMENTS

| | | | |
|---|---|---|---|
| 985,857 | 3/1911 | Thomas | 269/222 |
| 1,622,506 | 3/1927 | Graves | 269/16 |
| 1,716,718 | 6/1929 | Castagna | 269/221 |
| 2,507,931 | 5/1950 | Pizzonia | 269/16 |
| 2,541,508 | 2/1951 | Fleming | 144/286 R |
| 3,212,770 | 10/1965 | Stephens | 269/16 |
| 4,061,323 | 12/1977 | Beekenkamp | 269/139 |
| 4,114,665 | 9/1978 | Decker | 144/286 R |

OTHER PUBLICATIONS

Erik & Sloane, *A Museum of Early American Tools,* N.Y., Wilfred Funk Inc., 1964, pp. 8-9.

*Primary Examiner*—Robert C. Watson
*Attorney, Agent, or Firm*—Charles E. Markham

[57] ABSTRACT

A portable work table intended for home use, with or without detachable legs, has a rigid, elongated, rectangular frame and a pair of longitudinally extending members thereon forming a work surface and also functioning to clamp a workpiece therebetween, one member being fixed on the frame and the other member being moved thereon toward and away from the fixed member by a pair of independently operable, longitudinally spaced motion transmission screws; the work table being further provided with conveniently detachable, telescopically adjustable legs, and a compartment in the frame for storage of the detached legs.

9 Claims, 13 Drawing Figures

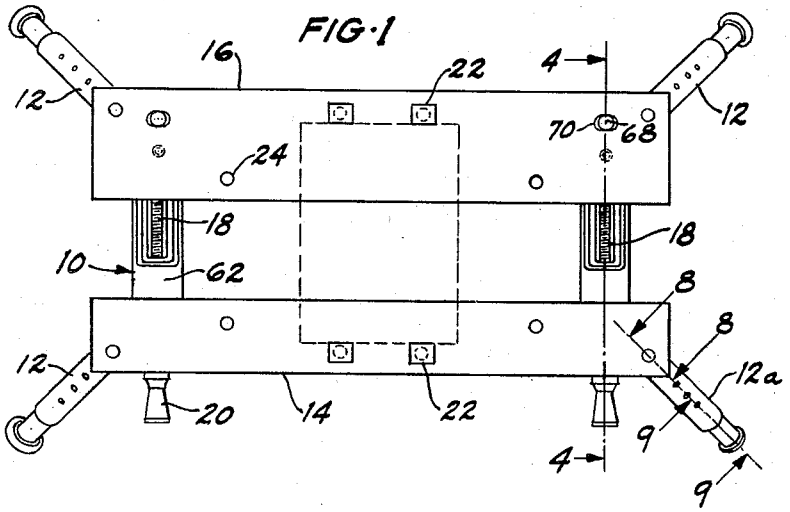
FIG·1
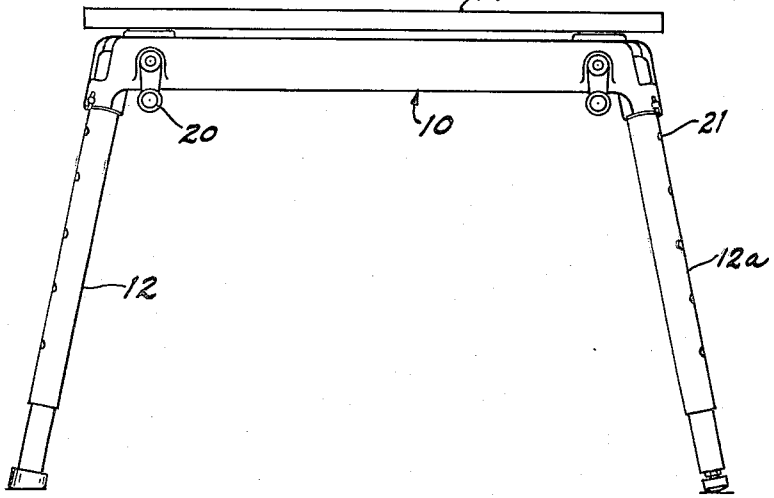
FIG·2
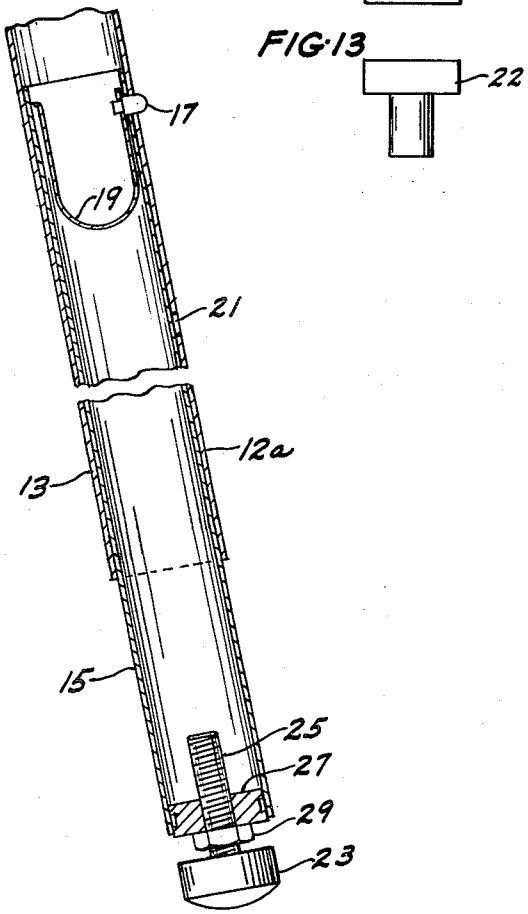
FIG·9
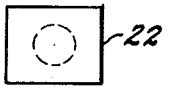
FIG·12
FIG·13

20
100
30
80
82
76
78
11
84
34
36
108
14
32
38
62
28
64
54
18
42
16
86
74
56
68
66
65
110
44
100
10
102
110
14
100
104
106
108

PORTABLE WORK BENCH

This invention relates generally to home use, portable work tables of the type having a work surface comprising two portions, one being movable with respect to the other to clamp a workpiece therebetween, and particularly to a work table of this kind having conveniently detachable legs and being adaptable to use with or without the legs.

THE PRIOR ART

The U.S. Pat. No. 788,436, to L. R. Slevin, discloses a planing or mitering table in which elongated work clamping members 7 are moved toward and away from each other by independently operable, longitudinally spaced screws 51. There is, however, no provision in the Slevin device to permit appreciable unilateral movement of the ends of the clamping members 7, which is a desirable feature required for clamping a workpiece having non-parallel sides. Moreover, the Slevin structure is quite complex and apparently not intended to be portable.

The U.S. Pat. No. 3,615,087, to R. P. Hickman, discloses a work table in which an elongated work surface and clamping member 22 is moved toward and away from a similar fixed member 21 by independently operable and longitudinally spaced screws 51. Nuts or so-called "slider" members 41, which threadedly receive screws 51, are fixed to each end of movable member 22 by a single wood screw 45 and are each rotatable as well as slidable in a longitudinal slot 30 in the underlying horizontal web 17 of a transverse support channel 14.

While this arrangement permits rotation at either end of the member 22 so that the ends may be moved unilaterally, any substantial unilateral movement of either end portion also requires lateral as well as longitudinal sliding movement of the nut 41 in the longitudinal slot 30. Lateral movement of nut 41 also results in lateral swinging of the motion transmission screws 51 engaged therein, which in turn requires suitable swivel mounting of screws 51 at their crank ends. Also, the single attaching screw 45 at each end of member 22 must withstand any clamping force imparted by the motion transmission screw 51 as well as any tendency of the member 22 to rise upward when clamping a workpiece having non-parallel or irregular vertical sides.

Moreover, the rigidity of the Hickman work surface supporting structure is dependent upon the tightness of screws 10 and the fixed wood beam 21 which connects the transverse support members 14 only at one longitudinal side of the table.

The U.S. Pat. No. 4,095,778, to H. R. Wing, discloses a combination work table and vise in which a movable work surface and clamping member 24 is moved toward and away from a fixed member 22 by a single intermediately positioned motion transmission screw 38 threadedly engaged in a block 42, which block has a swivel connection with movable member 24. Pins 74 attached to the ends of movable member 24 are guided sufficiently loosely in longitudinal slots 27 and 29 in transverse support channels 26 and 28 to permit sufficient lateral movement, as well as rotation, to accommodate substantial unilateral movement of the ends of movable member 24.

While this arrangement is effective to hold a workpiece having parallel or non-parallel sides when positioned intermediately of the length of members 22 and 24, as shown in FIG. 4, its effectiveness in securely holding a workpiece having parallel sides at either end of the members 22 and 24 would obviously be quite limited. Also, the rigidity of the work surface supporting structure in Wing is primarily dependent upon the connection of the transverse semicircular brackets 60 at one end thereof only by the wood beam 22.

OBJECTS OF THE INVENTION

The primary object of this invention is to provide a generally new and improved portable work table having a divided work surface forming a work holding means which is of particularly rigid and simple construction, light in weight, and requires a minimum of storage space when not in use.

A further object is to provide a work table of this kind having improved screw-operated means for moving one portion of the divided work surface toward and away from the other.

A further object is to provide a work table of this kind having conveniently detachable legs and a rigid, unitary frame for supporting the divided work surface portions so that the device may be used with or without the legs.

A further object is to provide a work table of the kind characterized in the preceding three paragraphs having four conveniently detachable, telescopically adjustable legs, and a compartment in the frame for the storage of the detachable legs.

Other objects and advantages will become apparent upon reading the following description in connection with the accompanying drawings.

IN THE DRAWINGS

FIGS. 1 and 2 are top plan and front elevational views of a portable work table with work clamping means constructed in accordance with the present invention;

FIG. 9 is a fragmentary, longitudinal, cross-sectional view of one of the telescopically adjustable legs and is taken along lines 9—9 of FIG. 1;

FIGS. 12 and 13 are top plan and side elevational views, respectively, of the insertable work-holding dogs.

DESCRIPTION OF A PREFERRED FORM OF THE INVENTION

Figures 3, 5, 6, 7, 10, 11:
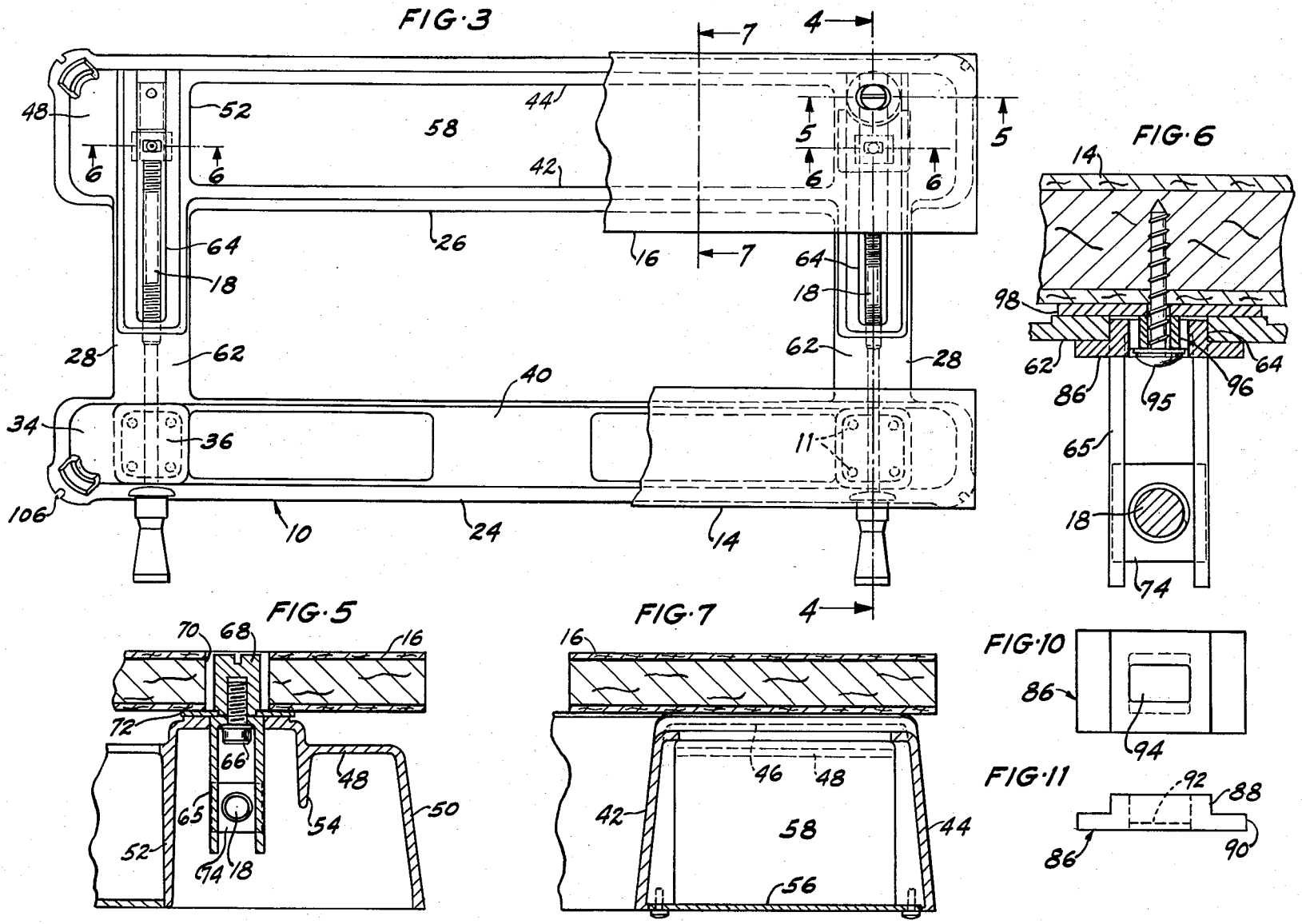
FIG. 3 is an enlarged top plan view of the work table with the legs removed and portions of the work surface members cut away so as to more clearly show construction of the rigid support frame.
FIG. 5 is a fragmentary cross-sectional view taken along lines 5—5 of FIG. 3.
FIG. 6 is an enlarged fragmentary cross-sectional view taken along lines 6—6 of FIG. 3.
FIG. 7 is a fragmentary cross-sectional view showing the storage compartment taken along lines 7—7 of FIG. 3.
FIGS. 10 and 11 are top plan and side elevational views, respectively, of the slidably guided, hold-down member.

Referring to FIGS. 1 and 2 of the drawings, the work table comprises a rigid, horizontally arranged, elongated, rectangular frame 10 having four round, tubular, telescopically adjustable legs 12 and 12*a* detachably connected thereto. A longitudinally extending work surface board 14 is fixed to frame 10 at the front longitudinal side of the table by screws 11 and a rear longitudinally extending work surface board 16 is slidably movable laterally on the frame toward and away from fixed board 14.

A pair of independently operable motion transmission screws 18 having cranks 20 attached to their front ends are journalled and restrained against axial movement in the front longitudinally extending frame member. At their other ends the screws 18 are threadedly engaged in nuts operatively connected to the rear board 16 so that opposite end portions of board 16 may be moved independently or in unison toward and away from front fixed board 14, whereby a workpiece having either parallel or non-parallel opposed surfaces may be effectively clamped between the adjacent vertical surfaces of boards 14 and 16.

A workpiece, shown in dotted line in FIG. 1, lying on the surface of boards 14 and 16 and of such dimensions that it cannot be inserted between the boards 14 and 16 when in their maximum spaced positions, may also be clamped between work holding dogs 22, selectively insertable in holes 24 in boards 14 and 16. The operative connection with the board 16 of the nuts receiving the transmission screws 18 is such as to permit substantial unilateral movement of the end portions of board 16.

Figures 4, 8:
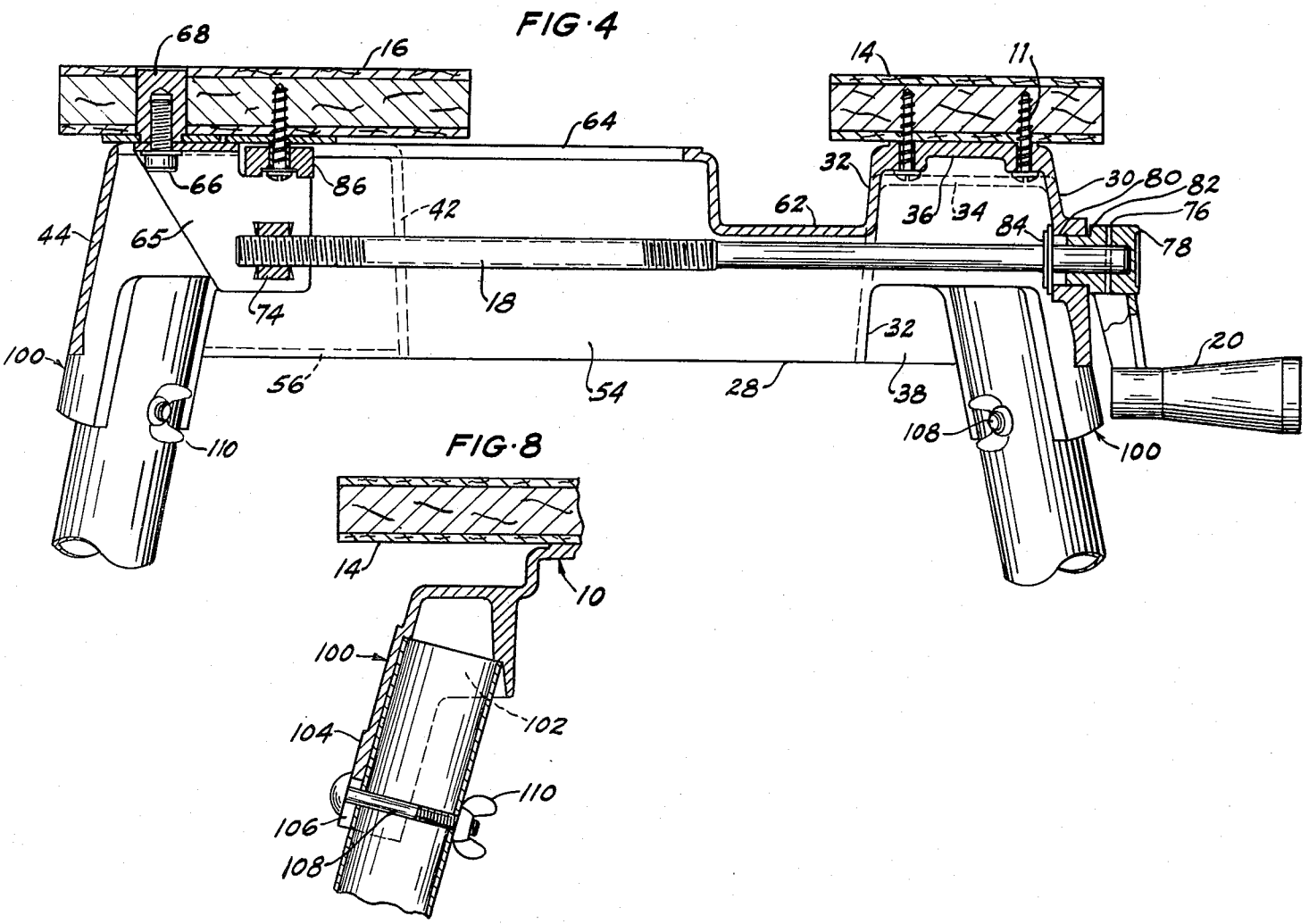
FIG. 4 is a still further enlarged transverse cross-sectional view taken along lines 4—4 of FIG. 1 or 3.
FIG. 8 is a fragmentary cross-sectional view showing the connection of the detachable legs to the frame and is taken along lines 8—8 of FIG. 1.

Referring to FIG. 3, the elongated rectangular frame 10 comprises a front longitudinal member 24, a rear longitudinal member 26, and transverse members 28 intersecting the longitudinal members 24 and 26 near their ends. Referring to FIG. 4, the front longitudinal frame member 24 has spaced vertical walls 30 and 32 which are joined at their ends by top wall portions 34 and 36 and vertical end walls 38. Vertical walls 30 and 32 are also joined intermediately of their length by a top wall portion 40, see FIG. 3. Referring to FIG. 7, the rear longitudinal frame member 26 has spaced vertical longitudinal side walls 42 and 44 joined at their end portions by top wall portions 46 and 48 and by vertical end walls 50, 52, and 54, see FIG. 5.

Referring to FIG. 7, the vertical sidewalls 42 and 44, end walls 52, and an attached bottom wall 56 of the rear frame member 26 define an elongated compartment 58 extending between the transverse frame members 28 which is provided for the storage of detachable legs 12 and 12*a* and miscellaneous tools. It will be noted that compartment 58 is closed at the top by the movable work surface board 16 when it is in its rearward position, shown, and is open when board 16 is moved forward.

The vertical sidewalls 52 and 54 of transverse frame members 28 are joined to sidewalls 32 of front frame member 24 and to sidewalls 42 and 44 of rear frame member 26. Sidewalls 52 and 54 are also joined by top wall portions 62. The frame 10 is preferably formed as a unitary casing of lightweight metal, such as an aluminum alloy.

The rearward extending portions of the top wall portion 62 of transverse frame members 28 each have a longitudinally extending slot 64 formed therein, which slots slidably receive the upper portion of inverted U-shaped members 65, see FIG. 5. Attached to the upper connecting leg of members 65 by means of cap screws 66 are metal cylindrical pins 68 of relatively large diameter which extend into longitudinally elongated apertures 70 in rear members 65. Nuts 74 carried in the downwardly extending legs of the U-shaped members 65 threadedly receive rearwardly extending portions of the motion transmission screws 18. The forward ends of screws 18, see FIG. 4, are attached by pins 76 to the hubs 78 of cranks 20. The crank hubs 78 have reduced diameter portions journalled in bores 80 in the front wall 30. Screws 18 are prevented from moving axially forward by washers 84 fixed on the screws.

Positioned forward of and in axial alignment with each of the U-shaped members 65 is a board hold-down member 86. The member 86, see FIGS. 6 and 10, has a narrower upper portion 88 with vertical sides slidably fitting in the slot 64 and a wider lower portion 90 having upper horizontal surfaces bearing against the underside of wall 62. Member 86 is further provided with an elongated aperture 94 through which a short, hollow, cylindrical member 96 extends. The slidable hold-down member 86 is retained in slot 64 by the head of a screw 95. The head of screw 95 bears against the lower horizontal surface 92 of member 86 and the screw passes through the hollow cylindrical member 96 and into the board 16. There is a washer 98 between the cylindrical member 96 and the underside of board 14. The hollow cylindrical member 96 is of such length that it slightly spaces the member 86 and the washer 98 to permit the free sliding of member 86 in slot 64 and the free sliding and rotation of washer 98 and the board 16 on the upper surface of top wall 62.

From the foregoing, it will be seen that the operative connection between screws 18 and the board 16 to move the board horizontally is through the pins 68 rigidly attached to slidably guided members 65 and that the board 16 is held down by the forwardly spaced, slidably guided, hold-down members 86. Therefore, when considerable clamping force is imparted to the board by cranks 20 and screws 18 to tightly clamp a workpiece, this force is transmitted to the board through the relatively large diameter metal pins 68 rigidly attached to the slidable members 65 by cap screws 66, and the board is held down against any tendency to rise upward by the forwardly spaced hold-down members 86. Thus, this arrangement provides a particularly rugged construction capable of repeatedly withstanding considerable stress.

When one of the screws 18 is rotated relative to the other, one end portion of board 16 will move freely relative to its other end due to the provision of the longitudinally elongated apertures 70 in the board and the longitudinally elongated apertures 94 in hold-down members 86. The apertures 70 and 94 are sufficiently elongated to permit either end of rear board 16 to be moved forward into contact with front board 14 while the other end thereof remains in its rearwardmost position as shown. It will be noted that screws 18 and nuts 74 will always remain in alignment with slots 64 irrespective of whether the screws are rotated in unison to effect forward movement of board 16 parallel with front board 14 or relative to each other to effect non-parallel forward movement.

Referring to FIG. 8, the upper end portions of detachable legs 12 and 12*a* are received in sockets formed in integral bosses 100 extending downwardly and outwardly from the corners of frame 10. A short cylindrical socket portion 102 having a completely surrounding wall is formed in the upper portion of bosses 100 and receives a short upper end portion of the legs. A longer downwardly extending hollow semicylindrical portion 104 of bosses 100 provides a semicylindrical socket portion having an outwardly facing wall which receives a longer inwardly spaced end portion of the legs. The semicylindrical wall portion 104 has a longitudinal slot 106 in the lower end thereof which receives the head end portion of a bolt 108, which bolt extends through the leg and has a wing nut 110 on the end thereof.

The axes of the downwardly directed leg sockets diverge outwardly sufficiently along lines lying at 45° to the longitudinal and transverse sides of the frame 10 to add substantial stability to the work table against leg flexure. When the legs are disassembled they may be stored in the elongated compartment 58 in frame 10.

Referring to FIG. 9, the telescopically adjustable legs 12 and 12*a* comprise round tubular upper portions 13 and slightly smaller diameter, round, tubular, lower portions 15 slidably entered into the upper portions 13. At their upper ends, the lower leg portions 15 are each equipped with a retractable latch pin 17. Latch pin 17 has an interior end attached to the free end of an interior, flat, U-shaped leaf spring 19 and extends exteriorly through a hole in the leg wall. The other end of spring 19 is anchored in the leg wall. The upper leg portions 13 have spaced apertures 21 therein which may selectively receive latch pins 17 to fix the leg portions in an adjusted position.

Three of the legs 12 have suitable feet fixed to the lower ends of their lower portions 15. A fourth leg 12*a* is, however, provided at the lower end of its lower portion 15 with a longitudinally adjustable foot 23. Foot 23 has a screw-threaded stem 25 threadedly engaged in a plug 27 fixed in the lower end of leg portion 15. A lock nut 29 when tightened against plug 27 maintains the adjustment of foot 23.

A further important advantage of providing a home use portable work table of the kind described, having the rigid frame 10 and the downwardly and outwardly extending integral bosses 100, is that the table may be used effectively with or without the conveniently detachable legs. It will be seen that the frame 10 may be placed upon the surface of any available work bench or table and employed to hold irregular shaped or unwieldy objects in a position in which they can be conveniently repaired, re-formed, or assembled. The downward extension of bosses 100 and the depth of frame 10 sufficiently space the boards 14 and 16 from an underlying surface to permit considerable downward extension of an object clamped between the boards.

We claim:

1. A portable work table and work holding device comprising a horizontally arranged, elongated, rectangular frame consisting of rigidly connected longitudinal and transverse frame members, one of said longitudinal frame members having horizontally spaced vertical side walls, a horizontal bottom wall and vertical end walls forming a longitudinally extending elongated compartment in said frame member open at the top for storage, a pair of boards coextending longitudinally on the upper surface of said frame, one of said boards extending along one longitudinal side of said frame and being fixed thereto, the other of said boards being slidably movable laterally toward and away from said fixed board, and screw-operated means for moving said slidably movable board toward and away from said fixed board, a socket formed at each corner of said frame receiving the upper portions of legs having such length as to space said frame at a convenient working height from a floor, means detachably connecting said legs to said frame, said elongated compartment being sized for reception of said legs when said legs are detached from said frame, said laterally slidable board being slidably movable into positions for covering and uncovering the top of said compartment, said frame having sufficient rigidity and vertical depth to render the device operable as a work surface and work holding means when said detachable legs are removed and said frame is placed directly upon a supporting surface.

2. The device claimed in claim 1 in which others of said longitudinal and transverse frame members are hollow and have horizontally spaced vertical sidewalls connected by vertical end walls and horizontal top wall portions, and in which said members and the walls and wall portions thereof are formed as an integral unit of a rigid lightweight material thereby to provide a particularly rigid lightweight frame.

3. The device claimed in claim 1 in which said leg receiving sockets are formed in four integrally formed bosses extending downwardly from the corners of said frame, said bosses extending downward substantially below the lower surface of said frame thereby to vertically space said frame from an underlying surface upon which said frame may be placed when said legs are removed therefrom.

4. A work table and work holding device having an elongated rectangular frame comprising longitudinal and transverse horizontal members, said transverse frame members having horizontally spaced vertical sidewalls, a horizontal connecting top wall and a longitudinally extending slot in said top wall, a pair of boards lying side by side on the upper surface of said frame and extending longitudinally of the frame over said transverse frame members, one of said boards being fixed to said frame and the other being slidably movable toward and away from the fixed board and said movable board having a longitudinally elongated aperture therein near each end thereof, a screw-threaded rod extending longitudinally between said sidewalls of each of said transverse frame members and journalled and constrained against axial movement in said frame, a first member slidably guided in said slot in each of said transverse frame members, said first members each including a vertical cylindrical pin entering one of said elongated apertures in said movable board thereby to permit angular movement of said board when said screws are rotated by differing amounts, and a second member slidably guided in said slot in each of said transverse frame members for holding said movable board on said frame, said second members each being connected to said movable board by a single screw passing through an aperture in said second member.

5. The device claimed in claim 4 in which the points of connection of said second slidably guided members with said movable board are spaced from said cylindrical pins in a direction toward said fixed board.

6. The device claimed in claim 4 in which said second members have an upper portion slidably fitting said slots in said horizontal top walls of said transverse frame members and a lower portion wider than said slots bearing against the lower surface of said top walls.

7. The device claimed in claim 4 in which said longitudinal frame members have horizontally spaced vertical sidewalls and longitudinally spaced horizontal connecting top wall portions.

8. The device claimed in claim 4 in which one of said longitudinal frame members has vertical sidewalls, vertical end walls, and a bottom wall forming a compartment open at the top, and in which said movable board is at least as wide as said compartment and is movable laterally sufficiently by rotation of said screw-threaded rods to positions to close or open the top of said compartment.

9. In a work table and work holding device in which a pair of elongated boards lying horizontally side by side on underlying support structure provide a work surface, and wherein one board is fixed and the other is moved laterally toward and away from the fixed board by a pair of longitudinally spaced transverse screws mounted in said support structure and threadedly engaged in a pair of nuts connected to the movable board, the improvement which consists in: providing means closely guiding said nuts for transverse movement in said support structure in axial alignment with said screws, means operatively connecting said nuts to said movable board including vertical cylindrical pins connected to said nuts and entered into longitudinally elongated apertures in said board, and a pair of hold-down members slidably guided transversely in said support structure in axial alignment with said screws and connected to said movable board, the points of connection of said hold-down members with said movable board being spaced from said cylindrical pins in a direction toward said fixed board and said connection of said hold-down members to said movable board being such as to permit angular and limited longitudinal linear motion of said board in a horizontal plane relative to said hold-down members.

* * * * *